United States Patent [19]

Bell et al.

[11] 4,047,660

[45] Sept. 13, 1977

[54] COMPOSITE PACKAGE

[75] Inventors: Richard L. Bell, Glenmore; John D. Desmond; Joseph J. Hart, both of Philadelphia, all of Pa.

[73] Assignee: Container Corporation of America, Chicago, Ill.

[21] Appl. No.: 642,741

[22] Filed: Dec. 22, 1975

[51] Int. Cl.[2] ..... B65D 5/70; B65D 5/72; B65D 17/24

[52] U.S. Cl. ..... 206/620; 206/270; 206/807; 220/339; 220/352; 222/153; 222/541; 229/17 R; 229/44 R

[58] Field of Search ..... 206/265, 270, 528, 540, 206/807, 416, 413; 229/7 R, 23 R, 23 BT, 23 A, 17 R, 51 D, 43, 44 R; 220/339, 352; 222/153, 541

[56] References Cited

U.S. PATENT DOCUMENTS

| | | | |
|---|---|---|---|
| 1,887,075 | 11/1932 | Walter | 222/541 |
| 2,351,812 | 6/1944 | Guyer | 229/51 D |
| 2,925,210 | 2/1960 | Fallert | 229/43 |
| 2,960,264 | 11/1960 | Walter | 206/266 |
| 3,063,593 | 11/1962 | Kuchenbaker | 229/23 A |
| 3,168,952 | 2/1965 | Palmer | 206/45.31 |
| 3,259,298 | 7/1966 | Gorton | 229/43 |
| 3,265,282 | 8/1966 | Maxwell | 229/7 R |
| 3,640,446 | 2/1972 | Grieve | 229/17 R |
| 3,872,996 | 3/1975 | Dogliotti | 220/339 |

*Primary Examiner*—William Price
*Assistant Examiner*—Bruce H. Bernstein
*Attorney, Agent, or Firm*—Carpenter & Ostis

[57] ABSTRACT

A pilfer-resistant, composite package including a plastic cap member and a paperboard body member having integral flap means for retaining said cap member on said body member.

5 Claims, 6 Drawing Figures

COMPOSITE PACKAGE

SUMMARY OF THE INVENTION

The invention relates to pilfer-resistant packages which cannot be opened without providing evidence of such opening.

The present invention relates primarily to composite dispensing packages formed of paperboard and plastic which include a plastic cap member and a paperboard body member.

It is an object of the invention to provide a package of the type described wherein the paperboard body member includes flap means extending from the body member over the cap member to retain a latter on the former.

A more specific object of the invention is the provision of tab means which must be partially removed to afford access to the cap member.

Another specific object of the invention is to provide a dispensing feature in the cap member.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

Figure 1:
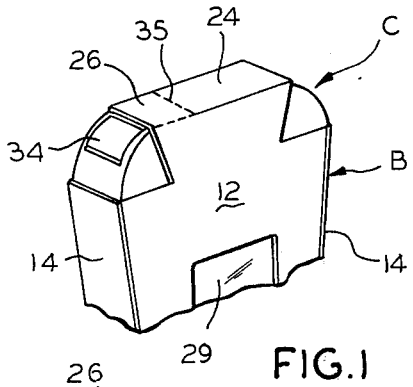
FIG. 1 is a perspective view of a composite package embodying features of the invention, as seen before initial opening.

Referring now to the drawings for a better understanding of the invention, it will be seen that the novel pilfer-resistant or tamper-proof package embodying features of the invention is a composite package which, as illustrated in FIG. 1, includes a preferably paperboard body member indicated generally at B, and a preferably molded plastic cap member indicated generally at C. The cap member C is disposed over the top of the body member B and secured thereto by flap means in a manner hereinafter described.

Figure 4:
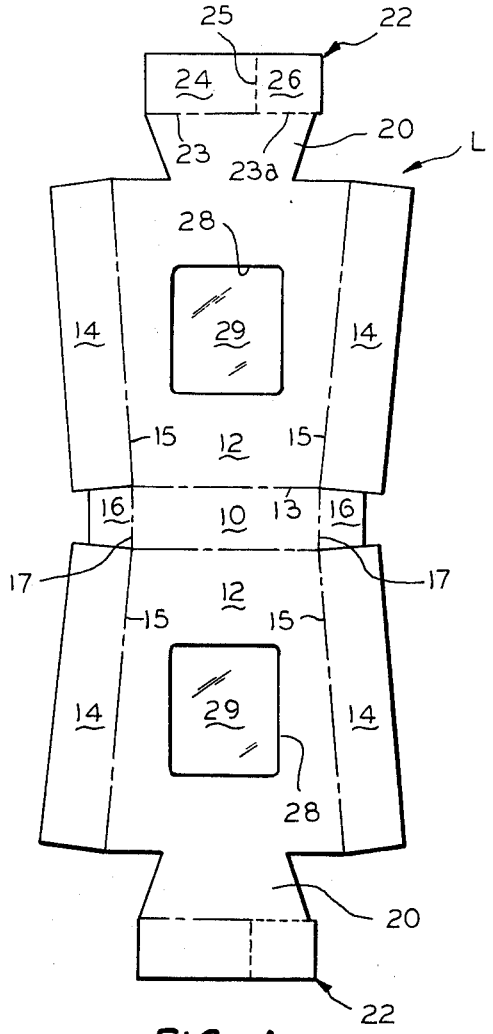
FIG. 4 is a plan view of a paperboard blank from which the body member of the other views may be formed.

As best seen in FIG. 4, body member B may be formed from a unitary blank L of foldable sheet material such a paperboard. Body member B includes a relatively narrow bottom wall 10 having a pair of opposed front and rear side walls 12 foldably connected to its front and rear side edges along fold lines 13, and a pair of end flaps 16 foldably connected to its end edges along fold lines 17. Each of the side walls 12 has a pair of end wall panels 14 foldably connected to its opposite side edges along fold lines 15. Thus, end wall panels 14 and end flaps 16 when secured together in overlapping relation, as shown in FIG. 3, form a pair of opposed end walls which cooperate with bottom wall 10 and side walls 12 to provide a box-like structure open at the top.

Figure 3:
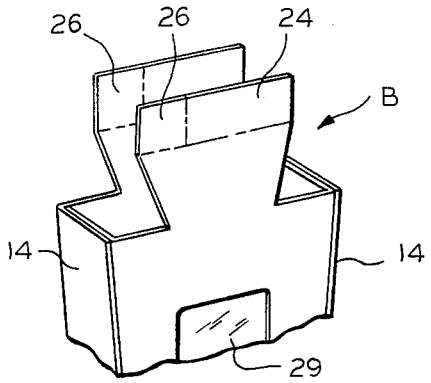
FIG. 3 is a fragmentary perspective view of the package body member.

As best seen in FIGS. 3 and 4, body member side walls 12 are provided with generally trapezoidal shaped, upwardly projecting extensions 20 which are defined by converging sides edges, so as to be wider at the top than at the bottom.

Still referring to FIGS. 3 and 4, it will be seen that there is provided at the upper end of each of the extensions 20, a top flap 22 comprising a major section 24 and a removable section 26 detachably joined to each other by a line of perforation 25. Section 24 is foldably connected to its related side wall extention 20 on a fold line 23, and removable section 26 is detachably connected to the upper edge of the related side wall extension 20 along a line of perforation 23*a* which is aligned with fold line 23. Either or both of the side walls 12 may be provided with a centrally disposed window opening 28 which may be covered with a sheet of transparent film 29 adhesively secured to the inner surface of the side wall in a conventional manner.

Figure 5:
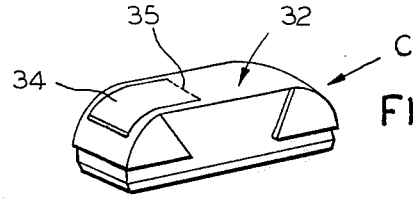
FIG. 5 is a perspective view of the package cap member with the dispensing lid shown in the closed position.
Figure 6:
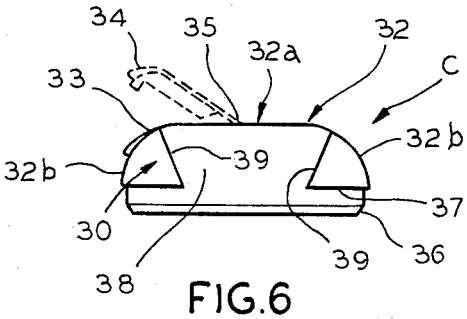
FIG. 6 is a side elevation of the cap member, with the dispensing lid shown in the open position.
Figure 2:
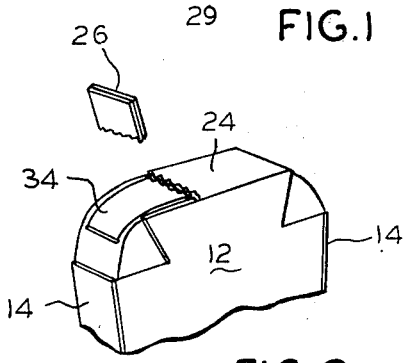
FIG. 2 is a view similar to FIG. 1, but shown after the pilfer resistant tab has been removed for initial opening.

Cap member C, as best seen in FIGS. 5 and 6, includes a pair of spaced, parallel side walls 30 which are interconnected by an integral, transversely extending intermediate wall 32, which includes a central portion 32*a* and a pair of opposed end portions 32*b*.

Intermediate wall 32 is provided with an integral cover or lid 34 which is hingedly attached to the intermediate wall on transverse hinge line 35, so that the cover is lifted it affords access to the interior of the package through an opening 33 in the intermediate wall of the cap member.

Cap member C also indludes a depending peripheral skirt 36 which is set in from the intermediate and side walls to provide a downwardly facing shoulder 37, which is adapted to be seated on the upper edges of the body member side and end walls to close the upper end of body member B.

Cap member C is positioned between the body member side wall extensions 20, and its side walls 30 may be provided with recesses 38, defined by downwardly covering shoulders 38, to receive and engage the side edges of the body member side wall extensions 20. Thus, an interlocking relationship is provided between the cap and body members by reason of the cap member skirt shoulders 37 and side wall recess shoulders 39.

After the cap member has been placed over the body member, as previously described, the top flaps 22 are folded over 90° into overlapping relationship with each other and secured together on top of the cap member to snugly retain the cap member in position on the body member.

In order to make the package pilfer-resistant or tamper-proof, the top flap removable section 26 are positioned to cover the cap member opening 33 and cover 34, so that in order to have access to the opening it is necessary to detach removable sections 26 from the major sections 24 of the top flaps. It will be apparent that after the package has been initially opened, the detachment or destruction of removable sections 26 will constitute evidence of such opening of the package.

Thus, it will be appreciated that the invention comprises a novel dispensing package which is relatively inexpensive to produce and yet provides a pilfer-resistant ot tamper-proof feature which is extremely convenient for use.

We claim:

1. In a two-piece, composite pagkage, the combination of:

a. a body member formed of foldable paperboard and including a bottom wall and opposed pairs of side and end walls upstanding therefrom to form a boxlike structure open at the top;

b. a cap member including a dispensing opening and a cover for said opening and defining a cover structure open at the bottom;

c. said cap member including a depending skirt portion received within the upper portion of said body member;

d. said body member including flap means foldably connected to an upper edge of at least one of said walls and extending over a portion of said cap member to retain said cap member on said body member;

e. said flap means including a removable tab detachably joined thereto and overlying said cap member dispensing opening.

2. In a two-piece, composite package, the combination of:

a. a body member formed unitary blank of foldable paperboard and including a bottom wall and opposed pairs of side and end walls upstanding therefrom to form boxlike structure open at the top;

b. said opposed side walls having medial portions extending above the remaining portions of said walls and said end walls;

c. a cap member formed of molded plastic and defining a cover structure open at the bottom;

d. said cap member including a depending skirt portion received within the upper portion of said body member;

e. said body member including a pair of flaps foldably connected to upper edges of said side wall medial portions and secured to each other in overlapped relation over said cap member.

3. A package according to claim 2, wherein said cap member includes, at least in side portions thereof, recessed areas for receiving said medial portions of said body member side walls.

4. A package according to claim 3, wherein said side wall medial portions and said cap member recessed areas are larger at the top than at the bottom.

5. In a two-piece, composite package, the combination of:

a. a body member formed of foldable paperboard and including a bottom wall and opposed pairs of side and end walls upstanding therefrom to form a boxlike structure open at the top;

b. a cap member formed of molded plastic and defining a cover structure open at the bottom;

c. said cap member including a depending skirt portion received within the upper portion of said body member;

d. said cap member presenting a peripheral shoulder adjacent said skirt portion for engagement with upper edges of said body member walls;

e. said body member including flap means foldably connected to an upper edge of at least one of said walls and extending over a portion of said cap member to retain said cap member on said body member.

* * * * *